United States Patent [19]

Morrone

[11] Patent Number: 4,548,410

[45] Date of Patent: Oct. 22, 1985

[54] NUMBER PUZZLE

[76] Inventor: Giuseppe Morrone, 48 E. 15th St., Huntington Station, N.Y. 11746

[21] Appl. No.: 543,670

[22] Filed: Oct. 19, 1983

[51] Int. Cl.[4] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 471,941 | 3/1892 | Brown | 273/153 S |
| 483,276 | 9/1892 | Anderson | 273/153 S |
| 1,477,371 | 12/1923 | Larabee | 273/153 S |
| 3,208,753 | 9/1965 | Stotts | 273/153 S |
| 4,257,606 | 3/1981 | Launzel | 273/160 X |
| 4,269,414 | 5/1981 | DeVos | 273/153 S |

FOREIGN PATENT DOCUMENTS

| | | | |
|---|---|---|---|
| 765605 | 3/1934 | France | 273/153 S |

*Primary Examiner*—Anton O. Oechsle

*Attorney, Agent, or Firm*—Stephen E. Feldman

[57] ABSTRACT

A number puzzle is provided wherein a series of nine tiles, numbered 1–9 in seriatim are arranged in a 3×3 relationship and slidably disposed in one recess of a housing, with the housing having an auxiliary recess to accommodate one of the tiles so as to slidably move the other tiles. The object of the game is to arrange the tiles so that when the numbers are added horizontally, vertically or diagonally, the sum is "15".

5 Claims, 4 Drawing Figures

NUMBER PUZZLE

FIELD OF THE INVENTION

This invention relates to puzzles to game devices. Specifically, this invention relates to a number puzzle.

BACKGROUND AND DISCUSSION OF THE PRIOR ART

Hertofore it was known to provide certain number games or puzzles such as is disclosed in Gambardella, U.S. Pat. No. 3,966,209, granted June 29, 1976; Hartman, U.S. Pat. No. 1,464,424, granted Aug. 7, 1923; King, U.S. Pat. No. 2,791,430, granted May 7, 1957; Preston, U.S. Pat. No. 3,124,357, granted Mar. 10, 1964; and Solimene, U.S. Pat. No. 3,633,913, granted Jan. 11, 1972.

Such prior art devices were either lacking in challenge or were so unduly numerically complex so as to discourage broad utilization, while often some constructions were illsuited for hand-held play often requiring a table surface.

Now there is a number game which eliminates one or more of the disadvantages of the prior art construction, and is readily playable in a hand-held mode.

An object of this invention is to provide a hand-held game which can be played either as a solitaire type of game or can be played with an opponent.

Another object is to provide a puzzle as aforesaid which is amusing and fascinating to play and which will provide the player with challenged concentration.

Another object is to provide a puzzle which is relatively simple in construction, positive in operation and relatively inexpensive to manufacture.

Another object is to provide a puzzle-type game comprising a housing with associated tiles arranged to be manipulated between a randomly placed position and a predetermined orderly position on the game board in a manner in which a solution is rendered possible every time.

Another object of the invention is to provide a new and improved game which is simple to play and does not require complex and numerous rules and instructions.

DESCRIPTION OF THE PREFERRED EMBODIMENTS

Figure 1:
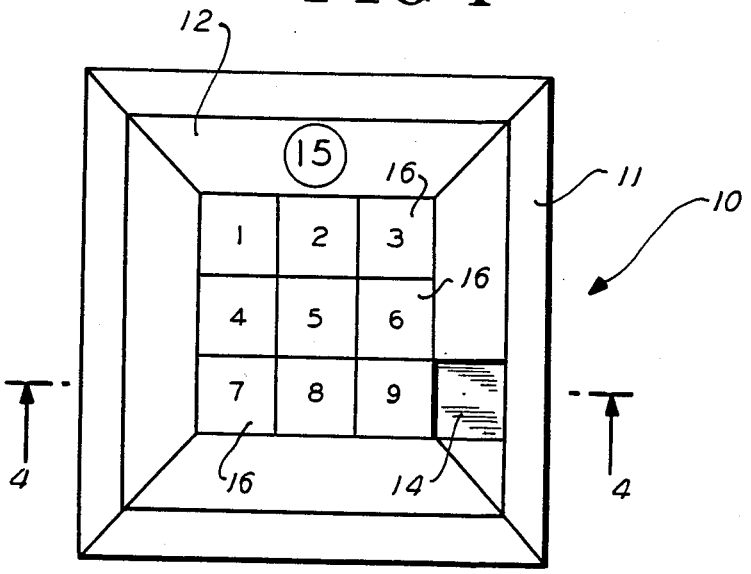
FIG. 1 is a top plan view of the number puzzle of the present invention.

Referring to the FIGURES there is shown the number puzzle of the present invention generally referred to as 10. Puzzle 10, in broad terms, includes an exterior frame 11, an interior housing or frame 12, forming a main square recess 13 and an auxiliary or access recess 14, and a plurality of nine tiles 16, numbered 1–9 in seriatim, for purposes hereinafter appearing.

Frame 11 is a square formed of four frame members 11*a*–11*d*, which frame members are corner angled and fixedly interconnected by well known means (not shown). Frame 12 is a square formed of five members

Figure 3:
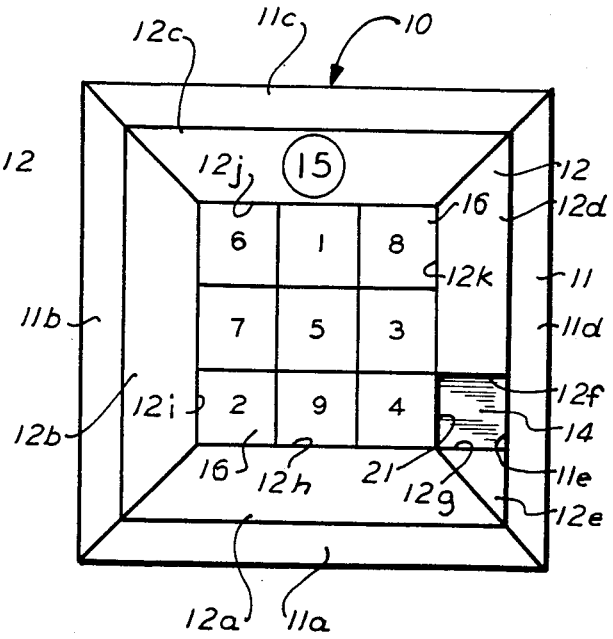
FIG. 3 is the number puzzle showing the solution.
Figure 4:
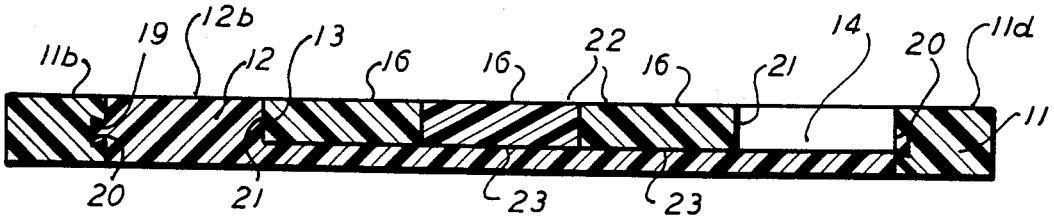
FIG. 4 is an enlarged sectional view taken along line 4—4 of FIG. 1.

12*a*–12*e*, with members 12*a*–12*c* being identical, and members 12*d* and 12*e* being differently sized. The peripheral edge of each member 12*a*–12*e* is formed with an undercut tongue 19 (typical) which is received in groove 20 formed on the inner peripheral edges of frame members 11*a*–11*d* (FIG. 4). In this manner of construction frame 12 holds frame 11 in place and forms recess 13 and recess 14. Recess 14 is bounded by wall 11*e* of frame member 11*d*, wall 12*f* of frame member 12*d*, wall 12*g* of frame member 12*e*, and one side wall 21 of any tile 16 (FIG. 3). Recess 13 is formed of interior peripheral walls 12*h*, 12*i*, 12*j* and 12*k* of frame members 12*a*–12*d*, respectively (FIG. 3).

Tiles 16 are each formed as square blocks having top surface 22 with numbers imprinted thereon and bottom surface 23 without imprinting, and four like side edges 21, which side edges slide with relation to each other, as well as in relation to the interior peripheral walls of the frame members.

Figure 2:
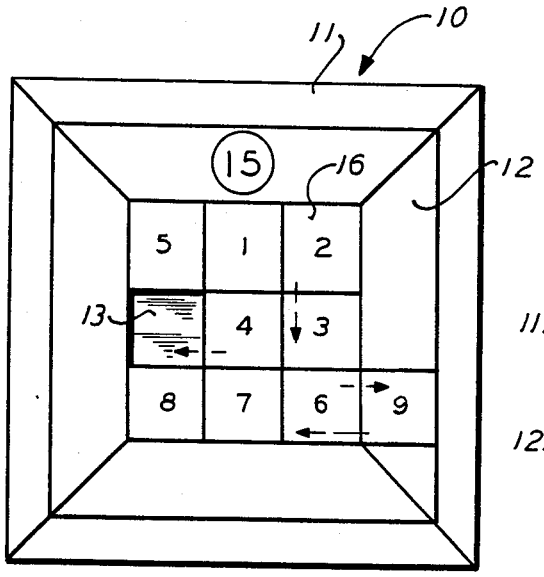
FIG. 2 is the number puzzle indicating the movement of the numbered tiles.

In playing the game the player may start from a random position and through manipulation of the tiles, by sliding one tile from recess 13 to recess 14, the other eight tiles may be slidably arranged. Of course, in the arrangement various tiles at any one time may individually be moved from the recess 13 to recess 14. With specific reference to FIG. 2 there is shown the manipulation of tile No. 9 to and from recesses 13 and 14, with concomitant manipulation of the other tiles. An opponent player may try to achieve the solution in less time or number of moves.

Now referring specifically to FIG. 3, there is shown the nine tiles arranged in recess 13 in the solution position wherein the sum of the numbers in each vertical, horizontal or diagonal line or row totals "15". An imprinted number "15" may be provided on the frame to assist the player in remembering the desired total.

The exterior frame, interior frame and tiles may all be constructed of molded plastic or other suitable material which permits sliding with a minimum of contact. The molding of these parts may be a well known techniques.

In one variation, the tiles and recesses may be cooperatively tongue and groove construction on adjacent sides so as to permit interfitting, and thereby lock the tiles within the frames.

While preferred specific embodiments of the invention are hereinbefore set forth, it is to be clearly understood that the invention is not to be limited to the exact constructions, materials, devices and symbols illustrated and described because various modifications of these details may be provided in putting the invention into practice.

What is claimed is:

1. A number puzzle comprising:

(a) a housing including an exterior frame and an interior frame and means to interconnect said exterior frame and said interior frame one to the other;

(b) said interior frame being formed with a fixedly disposed first recess, defined by walls formed on said interior frame, and a fixedly disposed second recess contiguous with a corner of said first recess and adjacent one corner thereof and of said interior frame;

(c) said exterior frame defining one wall of said second recess and said first recess defining an imaginary other wall for said second recess opposite said one wall;

(d) a plurality of numbered tiles being disposed in said first recess, and each of said tiles being individually slidably movable into and from said second recess, whereby tiles are movable so as to be arranged in a desired solution in said first recess;

(e) said tiles consisting of nine tiles numbered 1–9 in seriatim, and arranged 3×3 in said first recess, and wherein the solution is to arrange the tiles in said first recess so that the number sum of each three tiles arranged horizontally, vertically or diagonally is 15.

2. The number puzzle of claim 1, said frames comprising molded plastic.

3. The number puzzle of claim 2, said tiles comprising molded plastic.

4. The number puzzle of claim 3, said numbers being imprinted on the tiles.

5. The number puzzle of claim 1, said means to interconnect said frames being tongue and groove construction.

* * * * *